United States Patent [19]

Freermann

[11] Patent Number: 4,604,926

[45] Date of Patent: Aug. 12, 1986

[54] METHOD OF AND APPARATUS FOR AUTOMATICALLY ORIENTING A FABRIC WITH ALIGNED NAP ZONE AND NAPLESS ZONE

[75] Inventor: Johannes Freermann, Ochtrup, Fed. Rep. of Germany

[73] Assignee: Carl Schmale GmbH & Co. KG, Ochtrup, Fed. Rep. of Germany

[21] Appl. No.: 653,505

[22] Filed: Sep. 21, 1984

[30] Foreign Application Priority Data

Sep. 24, 1983 [DE] Fed. Rep. of Germany ..... 3334645

[51] Int. Cl.[4] ..... B26D 7/14; D06H 3/12

[52] U.S. Cl. ..... 83/18; 83/175; 83/216; 83/249; 83/368; 26/51.4; 26/51.5

[58] Field of Search ..... 83/18, 925 CC, 216, 83/249, 368, 175, 364, 438, 418, 421; 26/51.5, 51.4, 51.3

[56] References Cited

U.S. PATENT DOCUMENTS

| | | | |
|---|---|---|---|
| 2,716,266 | 8/1955 | MacIsaac et al. | 26/51.4 |
| 3,182,536 | 5/1965 | Sumpter et al. | 83/18 |
| 4,187,132 | 2/1980 | Dijk et al. | 26/51.5 X |
| 4,375,175 | 3/1983 | Elsas et al. | 83/18 |
| 4,437,369 | 3/1984 | Brocklehurst et al. | 83/18 |
| 4,493,234 | 1/1985 | Ziegler et al. | 83/175 |

FOREIGN PATENT DOCUMENTS

| | | | |
|---|---|---|---|
| 1760562 | 2/1972 | Fed. Rep. of Germany . | |
| 2130813 | 1/1973 | Fed. Rep. of Germany . | |
| 0082464 | 5/1984 | Japan | 26/51.4 |

*Primary Examiner*—Donald R. Schran

*Attorney, Agent, or Firm*—Karl F. Ross; Herbert Dubno

[57] ABSTRACT

Process and apparatus for automatically producing a fabric with aligned nap zone and napless zone includes a conveyor along which the fabric is transported in such a manner that its nap zone is located at one side of a press pad and the napless zone is located under and at the other side of the press pad. A clamping device can be lowered on the napless zone to pull the latter transversely to the conveying direction of the fabric so that the edge of the nap zone is forced towards the press pad and to be aligned parallel thereto. Through cutting the napless zone in conveying direction after the nap zone is urged to lie against the press pad parallel to the edge of the nap zone an exact alignment of the napless zone to the nap zone is achieved.

20 Claims, 3 Drawing Figures

METHOD OF AND APPARATUS FOR AUTOMATICALLY ORIENTING A FABRIC WITH ALIGNED NAP ZONE AND NAPLESS ZONE

FIELD OF THE INVENTION

My present invention relates to a method of and an apparatus for automatically aligning a fabric with a junction between a nap zone and a napless zone parallel to a transport path.

BACKGROUND OF THE INVENTION

In the production of textile fabrics, e.g. toweling and the like, it is a common practice to form a fabric having a nap zone bordered along at least one edge by a nap-free zone along which a stitch seam may be formed in a subsequent operation.

In transporting fabric pieces of this type to the sewing machine at which the stitched seam is to be formed, it is desirable to have the junction between the nap free zone and the nap zone aligned with the transport direction and, more accurately, in alignment with the desired transport path so that the seam, when it is ultimately formed, will exactly parallel this junction and the nap zone.

In practice, the nap free zone may vary in width along its length and if only the fabric edge is properly aligned with the transport path, the seam, while being parallel to the fabric edge, will appear to be irregularly spaced from the nap zone and hence the junction The German Auslegeschrift No. 21 30 813 describes an apparatus for compensating warping of edges of the fabric and alignment of the latter by means of edge sensors.

Although this apparatus has been proven useful in practice it has been found that the napless zone cannot be provided in an exact parallel manner to the edge portion of the nap zone. Consequently, the napless portion of the fabric will not have uniform width thus leading to irregular border portions.

OBJECTS OF THE INVENTION

It is thus an object of my present invention to provide an improved method of and apparatus for producing a fabric with aligned nap zone and napless zone obviating the aforestated drawbacks.

Another object of this invention is to provide an improved method of orienting the junction of a nap zone and a nap-free zone of a fabric piece on a conveyor with precise alignment with the conveyor path to permit parallel seaming by a sewing machine located downstream of the automatic orienting device.

Yet another object of the invention is to provide an apparatus or device for automatically orienting such fabric pieces.

SUMMARY OF THE INVENTION

I realize these objects, in accordance with the present invention, by transporting the fabric along a conveyor in such manner that the nap zone is arranged at one side of a press pad while the napless zone is located at the other side thereof. Thus, the edge of the nap zone can lie against the press pad and is arranged parallel thereto or parallel to the conveying direction since the press pad extends along the conveyor. When the edge of the nap zone is arranged in this manner, the napless zone can easily be cut exactly parallel to the edge of the nap zone so that the border which is obtained by sewing the napless zone is exactly parallel to the edge of the nap zone.

According to the teachings of my invention, the edge of the nap zone can be provided parallel to the press pad by using a clamping device which pulls the napless zone transversely to and away from the press pad so that the edge of the nap zone is forced to lie against the press pad. Through the provision of such a clamping device, an exact alignment of the nap zone and the napless zone is achieved whereby the napless zone has a uniform width along its entire length.

The press pad extends almost along the entire length of the conveyor and is spaced from to a side track which is adjacent to the conveyor and is provided to support the napless zone. Thus, the fabric is slid with its napless zone under the press pad so that this zone is located on the side track while the nap zone lies on the conveyor and against the press pad. The clamping device is located at a downward position above the side track and is movable toward and away from the side track as well as transversely relative to the press pad or conveying direction. When being in the lower position, the clamping device will pull the napless zone transversely relative to the press pad and thus draw the edge of the nap zone toward the press pad while when returning into the initial position adjacent to the press pad will be lifted or disengaged from the fabric. In providing this cycle, the clamping device moves in a closed elliptical path. In this connection, I may note that the force exerted by the press pad on the napless zone is higher than the pulling force exerted by the clamping device on the napless zone so that no nap will be pulled under the press pad towards its other side.

According to a further feature of the invention, the press pad is provided with a cutout which allows a relaxation of the fabric in case a warping occurs. This is especially the case when the fabric is e.g. provided with a finished border which is conveyed transversely to the conveying direction of the fabric. Since the clamping device cannot move or shift such a border once the press pad exerts a force thereon, the cutout will allow the compensation of the warping action of the fabric through its inherent tension. The cutout is usually closed by a slider which is lifted to open the cutout only when such a finished border portion passes a light barrier or a sensing device which then transmits a signal to a control device. The control device causes the opening of the slider. Simultaneous with the opening of the cutout by lifting the slider, the control device turns off the clamping device and disengages the latter from the fabric. This ensures that the fabric, specifically the nap zone of the fabric, will not be pulled under the press pad once the slider is in the lifted position.

According to the broadest aspects of the invention, a web of fabric material having a nap zone inwardly of a nap-free zone along at least one edge of the fabric is fed by a conveyor linearly toward an apparatus capable of stitching automatically a seam along the nap-free zone but precisely parallel to an edge of the nap zone and hence the junction between them. Critical to this invention is the orientation of the junction and hence the edge of the nap zone parallel to the conveyor path this, of course, distinguishes, the invention from earlier systems in which the free edge of the fabric and hence the edge nap-free zone was oriented parallel to the path.

This ensures that the seaming can be effected exactly parallel to the nap zone edge.

According to the invention, the nap zone edge during longitudinal displacement of the web is continuously stepped in small increments transversely to ensure alignment of this nap zone edge with the transport path.

A pressure pad in the form of a skid member bearing upon the web and acting as a hold-down element can form an abutment edge against which the nap zone edge rides with the adjoining portion of the nap free zone passing below this hold-down device, the incremental transverse advance of the web being effected until the nap edge rides along a lateral face of the hold-down device.

By bringing the nap edge directly against the hold-down device a highly precise orientation of the nap edge parallel to the transport path is ensured while the hold-down device acts as a presser ensuring firm engagement of the web by the transverse feeder.

According to another feature of the invention, the free edge of the nap-free zone is cut along a line parallel to the transport path and hence parallel to the nap edge to impart the desired width to this nap free region and true the edge of the fabric to a proper parallel relationship with the nap zone.

BRIEF DESCRIPTION OF THE DRAWING

The above and other features of my present invention will now be described in detail with reference to the accompanying drawing in which.

SPECIFIC DESCRIPTION

Figure 3:
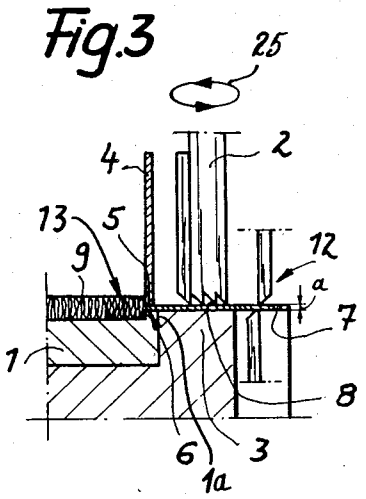
FIG. 3 is a sectional view taken along line III—III of FIG. 1.
Figure 1:
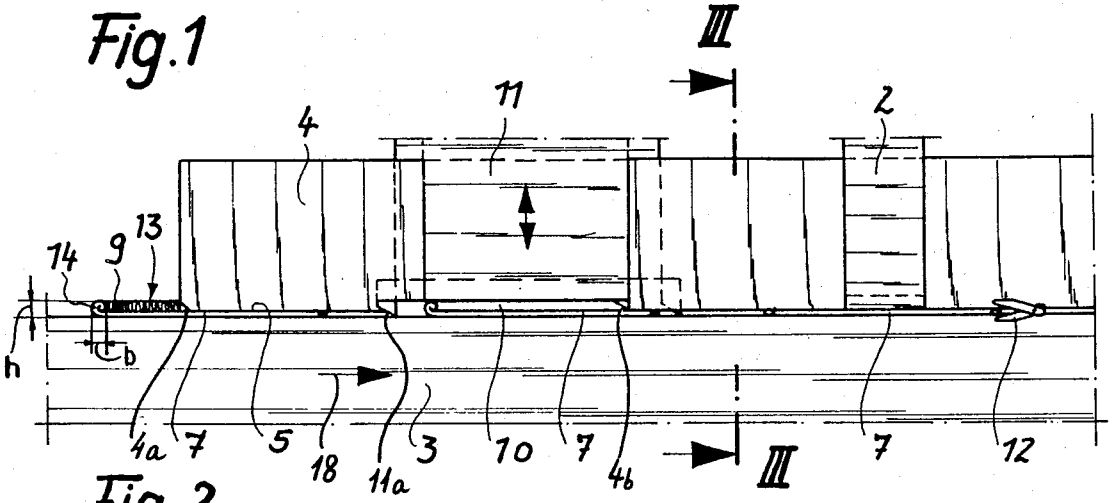
FIG. 1 is a side-elevational view of the apparatus according to the invention.
Figure 2:
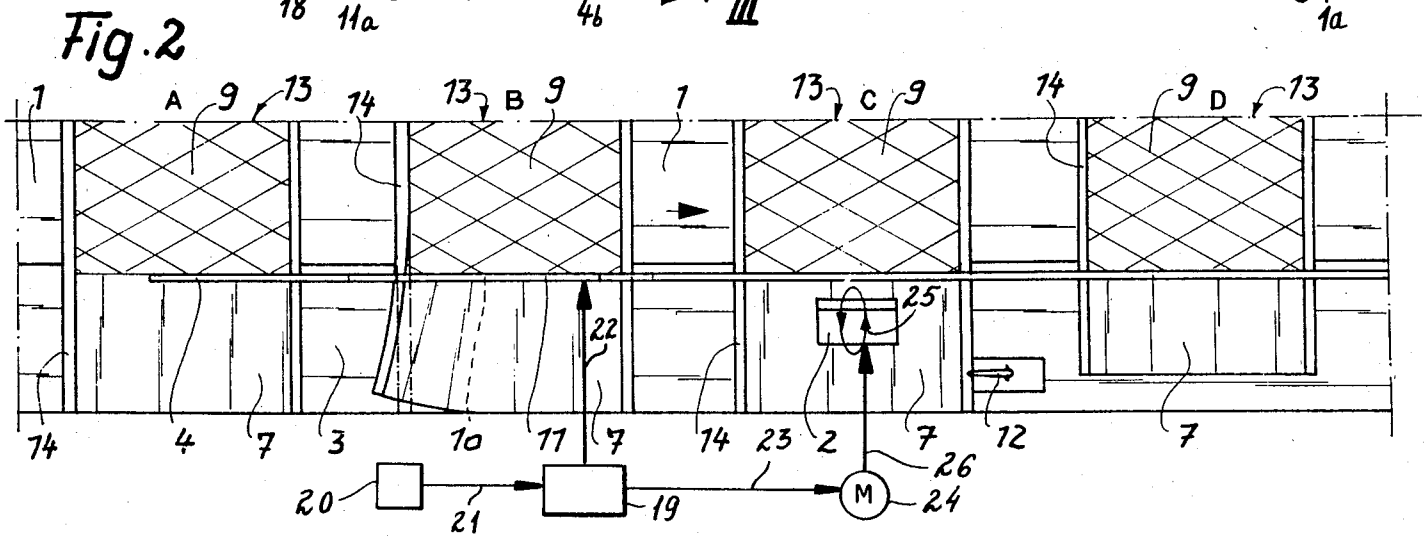
FIG. 2 is a top view of the apparatus of FIG. 1.

In the drawing, I have shown an apparatus for aligning a border portion of a piece of fabric 13 which includes a nap zone 9 and a napless zone 7 constituting the border portion which is to be formed to a hem. The apparatus has a conveyor 1 of any suitable design e.g. a belt conveyor which is driven by an electromotor (not shown) in a direction indicated by arrow 18. As is especially shown in FIGS. 2 and 3, a side track 3 is associated with the conveyor 1 along its length and is arranged at the same level as the conveyor 1. I may note that the side track 3 can also be provided as integral part of the conveyor 1. In case the fabric 13 has a nap zone 9 on both of its faces as illustrated in FIG. 3, the conveyor 1 is provided with a nose portion la whose upper surface is on the same level as the upper surface of the side track 3.

Extending almost along the entire length of the conveyor 1 and separating the conveyor 1 from the side track 3 is a press pad 4 which is fixed to a frame (not shown). The press pad 4 has a lower portion 5 shaped in a skid-like manner and arranged at a distance to the side track 3 so as to define a gap 6 between the press pad 4 and the side track 3. The so-formed gap 6 has a predetermined width which corresponds essentially to the thickness a of the napless portion 7 of the fabric 13. Consequently, the press pad 4 will keep the fabric 13 in position during its transport by the conveyor 1 and over the side track 3 by exerting a certain pressure thereon.

The apparatus according to my invention further includes a clamping device 2 which is fixed to the not shown frame and arranged next to the press pad 4 above the side track 3. The clamping device 2 has a serrated lower portion 8 facing the side track 3 and is driven by an electromotor arrangement 24 which moves the clamping device 2 in a vertical direction as well as transversely with respect to the conveying direction of the fabric 13. The connection between the electromotor 24 and the clamping device 2 is provided via e.g. an eccentric shaft indicated by numeral 26 so that the serrated clamp surface 8 will follow an elliptical path as indicated by arrow 25. It is preferable to adjust the operating cycle of the clamping device 2 to the speed of the conveyor 1 and thus to the traversing fabric 13. The movement of the clamping device 2 is further controlled in such a manner that the clamping device 2 is moved away from the press pad 4 when being in the lowered position thus pulling along the napless portion 7 of the fabric 13 by means of the clamp surface 8 and is returned toward the press pad 4 when being in the elevated position so as to be able to start the cycle again. I may note that the control and thus the movement of the clamping device 2 is synchronized to the operation of the conveyor which runs continuously.

When preparing the alignment of the napless portion 7 of the fabric 13 to provide e.g. a transverse border while a longitudinal border or hem 14 has already been produced, there is a problem in that the longitudinal border 14 which in conveying direction constitutes the trailing portion of the fabric 13 and thus is arranged transversely cannot be drawn or pulled once the longitudinal border 14 is clamped between the press pad 4 and the conveyor 1 as well as side track 3 because the clamping force exerted by the press pad 4 onto the border 14 is higher than the pulling force exerted by the clamping device 2. Consequently, the fabric 13 will suffer a warping as indicated in continuous lines in FIG. 2 position B. In order to compensate the warping action of the fabric 13 i.e. to provide a relaxation of the fabric of the generated tension, the press pad 4 is provided immediately prior to the clamping device 2 with a cutout 10 at its lower portion 5. The dimensions of the cutout 10 are selected in such a manner that its height corresponds at least to the height h of the longitudinal border 14 while its length in conveying direction is a multiple preferably five times of the width b of the border 14.

Accommodated by the press pad 4 is a slider 11 which is provided to open and close the cutout depending on the position of the trailing border - in the present embodiment the longitudinal border 14. The shifting motion of the slider can be provided by any suitable means e.g. through an electromotor or pneumatic means and is controlled by an electric or electronic device 19 via an output signal 22. In addition, the control device 19 controls the clamping device 2 via an output signal 23. Associated to the control device 19 is a sensing device or a light barrier 20 which provides an input signal 21 to the control device when the trailing border of the fabric 14 is in vicinity of the cutout 10.

In order to avoid a tangling or the like of the fabric 13 during its transport between the press pad 4 and the conveyor 1, the press pad 4 as well as the slider 11 each has a front edge **4*a* and 11*a*, respectively provided in a rounded or bevelled manner. Likewise, the press pad 4 has a rear edge 4*b* limiting the rear end of the cutout in conveying direction provided in a rounded or bevelled manner. In addition, it is preferred to provide the slider 11 in the closing position in such a manner that its lower edge is aligned with the skid portion 5 thus providing an uninhibited transport of the fabric 13**.

In this connection, I may note that it is certainly within the scope of the invention to provide the arrangement of the cutout 10 and the slider 11 behind the clamping device 2 in order to obtain the relaxation of the warped portion of the fabric i.e. the area of the trailing border.

Following the clamping device 2, the apparatus according to the invention includes a cutting device 12 which severs the outer portion of the napless area 7 so as to obtain a border exactly parallel to the nap portion 9 of the fabric 13. The cutting device 12 can be of any suitable design e.g. a scissor-like knife combination which is driven by a motor (not shown) and cuts the fabric 13 according to the advance movement thereof. I may note that the use of revolving blades or the like is somewhat disadvantageous since threads of the fabric may be drawn out and severed so that the exact alignment of the fabric 13 i.e. of the border portion is impaired After having described the individual parts of the apparatus according to the invention, I will now explain the mode of operation.

In case the piece of fabric, e.g. a towel, is to be provided with a transverse border or hem and a longitudinal border 14 has already been produced, the operator will place the fabric 13 on the conveyor such that the longitudinal border 14 extends transversely to the conveying direction of the fabric 13. The operator slides the fabric 13 under the press pad 4 into the gap 6 in such a manner that the edge portion of the nap zone 9 rests against the lateral face of the press pad 4. In FIG. 3, the fabric 13 is provided at its both sides with such a nap zone 9 so that the latter will rest against the press pad 4—as described—as well as against the nose portion 1*a* of the conveyor 1. The napless portion 7 of the fabric 13 is placed partly under the press pad and on the side track 3 (position A). This placement of the fabric 3 in cooperation with the press pad 4 will guarantee that no loops of the nap zone 9 will project toward the napless zone 7 and thus a sewing of loops into the border portion is avoided.

Once placed on the conveyor 1 in the described manner, the fabric 13 is automatically transported along the conveyor. When the fabric 13 reaches the clamping device 2, the latter will act with its clamping surface 8 on the napless zone 7 to pull the fabric 13 continuously toward the outside i.e. away from the press pad 4 so that the edge portion of the nap zone 9 is forced to lie against the respective lateral face of the press pad 4. It is to be noted that the clamping device 2 performs a working cycle in that the clamping surface is moved toward the outside when being in the lowered position thus acting on the napless zone and is lifted when returning into the initial position adjacent to the press pad 4.

As soon as the trailing border 14 of the fabric 13 is drawn under the skid 5 of the press pad 4, a warping of the fabric 13 will be obtained since the clamping device 2 pulls the napless zone 7 and thus the fabric 13 to the outside while the trailing portion of the fabric 13 is unable to perform a corresponding movement because the force exerted by the press pad 4 is too high (see position B in continuous lines). When the sensing device or light barrier 20 is passed by the longitudinal border 14, a corresponding input signal is transmitted to the control device 19 which then causes the slider 11 to move into the position opening the cutout 10. Simultaneously, the control device 19 stops the motor 24 of the clamping device 2 and causes a disengagement of the clamping portion 8 from the napless zone 7. Thus, the fabric 13 is able to compensate automatically the warping of the trailing portion by the tension generated in the material through the operation of the clamping device (see position B in dash-dotted lines). In this connection, I should emphasize that the cutout 10 has a dimension allowing the compensation of the warping of the trailing portion while the remaining major portion of the fabric 13 is still fixed in its position by the press pad 4 when the slider 11 is momentarily lifted to allow the relaxation of the fabric 13.

After the fabric 13 has been aligned in the described manner, the cutting device 12 severs an edge portion of the napless zone 7 exactly parallel to the line of the nap zone 9 and provides a napless zone of predetermined width for the subsequent sewing of the border (positions C and D). The fabric 13 is thus provided in a continuous operation with an aligned napless or border portion of predetermined width.

It is certainly conceivable to provide more than one of the described clamping device 2 for aligning the fabric 13.

After the so-aligned fabric 13 is transported to an arrangement for sewing the border portion, the fabric 13 may be placed on a further apparatus according to the invention to align and provide a border portion at the opposite side in an automatic manner.

Although the present apparatus has been described in connection with the alignment of a transverse border portion, the apparatus is certainly suitable also for the alignment of longitudinal border portions.

I claim:

1. A method of automatically producing a fabric with a nap zone and napless zone joining along a line comprising the steps of:

(a) continuously transporting the fabric along a conveyor in a direction parallel to said line;

(b) sliding said fabric under a guide elongated in and extending in said direction and pressing on said fabric;

(c) incrementally and iteratively drawing said napless zone laterally transverse to said direction to bring an edge of the nap zone against the guide;

(d) continuing to transport the fabric so that said edge of the nap zone continues to lie along the guide; and (e) severing a portion of the napless zone in such a manner that the napless zone has an outer edge parallel to the edge of the nap zone.

2. A method as defined in claim 1 wherein in step (d) the pressing of said guide on said fabric is relieved at a predetermined moment to allow the fabric through inherent tension to compensate for warping.

3. Apparatus for automatically producing a fabric with a nap zone and napless zone joining along a line comprising:

conveying means for transporting the fabric along a predetermined path in a direction parallel to said line;

a skid-shaped guide extending in said direction and abutting the nap zone while pressing upon said napless zone such that a corresponding edge of the nap zone lies against said guide;

aligning means incrementally and cyclically engaging said napless zone for drawing said edge of the nap zone against said guide; and cutting means for severing a portion of the napless zone in such a manner that the napless zone has an outer edge parallel to the edge of the nap zone, said conveying means including a conveyor and a side track adjacent said conveyor and extending along the latter, said aligning means engaging said napless zone above said track.

4. Apparatus as defined in claim 3 wherein said sIde track is an integral part of said conveyor.

5. Apparatus as defined in cIaim 3 wherein said separating means includes a press pad extending in direction of said conveying means at the junction of said conveyor and said side track, said press pad having a lower portion arranged at a distance from said side track to define a gap therebetween so as to aIIow the napIess zone of the fabric to be slid under said press pad and the edge of the nap zone to lie against said press pad.

6. Apparatus as defined in claiom 5 wherein said napless zone has a thickness, said gap having a width corresponding at least to the thickness of the napless zone.

7. Apparatus as defined in claim 5 wherein said aligning means includes a clamping device arranged at a predetermined location above said side track adjacent to said press pad and having a clamp surface facing said side track, said clamping device being movable between an upper and a lower portion with respect to said side track and movable transversely to the conveying direction of said conveyor such that said clamp surface traverses an elliptical path.

8. Apparatus as defined in claim 7 wherein said clamp surface moves away from said press pad when said clamping device is in the lower position so as to act upon the napless zone and moves toward said press pad when said clamping device is in the upper position.

9. Apparatus as defined in claim 5 wherein said press pad is provided with a cutout at its lower portion facing said side track so as to allow the fabric through its inherent tension to compensate any warping action of the fabric occurring during operation of said aligning means.

10. Apparatus as defined in claim 9 wherein said cutout has a height corresponding at least to the height of an already finished border portion of the fabric which border portion is to be conveyed between said press pad and said side track and constituting the rearmost portion of the fabric traversing said conveying means.

11. Apparatus as defined in claim 10 wherein said cutout has a length corresponding to a manifold of the width of the finished border portion.

12. Apparatus as defined in claim 11 wherein the length of said cutout is five times the width of the finished border portion.

13. Apparatus as defined in claim 10, and further comprising a slider accommodated in said press pad and movable between a first position in which said slider closes said cutout in such a manner that its lower edge is in alignment with the edge of said lower portion of said press pad and a second position in which said slider is lifted so as to expose said cutout.

14. Apparatus as defined in claim 13 wherein said slider and said press pad have a leading edge and said cutout is confined at its rear extension by a trailing edge of said press pad, each of said edges being rounded so as to avoid tangling of the fabric during its transport.

15. Apparatus as defined in claim 13 wherein said slider and said press pad have a leading edge and said cutout is confined at its rear extension by a trailing edge of said press pad, each of said edges being bevelled so as to avoid tangling of the fabric during its transport.

16. Apparatus as defined in claim 13 wherein said cutout and said slider are arranged at a location of said press pad preceding said aligning means.

17. Apparatus as defined in claim 13 wherein said cutout and said slider are arranged at a location of said press pad following said aligning means.

18. Apparatus as defined in claim 13, and further comprising controlling means for moving said slider in dependance on the position of the finished border portion during its transport along said conveying means, said controlling means moving said slider into said second position when the finished border portion is in vicinity of said cutout and into said first position when said finished border portion has traversed said cutout.

19. Apparatus as defined in claim 18 wherein said controlling means cooperate with said aligning means in such a manner that the latter is turned off and disengaged from the fabric when said slider is in the second position.

20. Apparatus as defined in claim 2 wherein said cutting means along said path is arranged subsequent to said aligning means and includes a scissor-like knife arrangement.

* * * * *